US006726815B1

(12) United States Patent
Artmann et al.

(10) Patent No.: US 6,726,815 B1
(45) Date of Patent: Apr. 27, 2004

(54) ELECTROCHEMICAL ETCHING CELL

(75) Inventors: Hans Artmann, Magstadt (DE); Wilhelm Frey, Palo Alto, CA (US); Franz Laermer, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/937,926

(22) PCT Filed: Mar. 17, 2000

(86) PCT No.: PCT/DE00/00857

§ 371 (c)(1),
(2), (4) Date: Dec. 26, 2001

(87) PCT Pub. No.: WO00/60143

PCT Pub. Date: Oct. 12, 2000

(30) Foreign Application Priority Data

Apr. 1, 1999 (DE) ..... 199 14 905

(51) Int. Cl.[7] ..... C25B 9/00; C25C 7/00; C25D 17/00

(52) U.S. Cl. ..... 204/267; 204/268; 204/DIG. 12; 205/640; 205/656

(58) Field of Search ..... 204/267, 268, 204/290.01, 291, 292, 293, DIG. 12; 205/640, 656

(56) References Cited

U.S. PATENT DOCUMENTS 4,220,508 A * 9/1980 Kotani et al. ..... 205/666
6,245,213 B1 * 6/2001 Olsson et al. ..... 205/646

* cited by examiner

*Primary Examiner*—Roy King
*Assistant Examiner*—Wesley A. Nicolas
(74) *Attorney, Agent, or Firm*—Kenyon & Kenyon

(57) ABSTRACT

An electrochemical etching cell (1) is proposed for etching an etching body (15) made at least superficially of an etching material. The etching cell (1) has at least one chamber filled with an electrolyte, and is provided with a first electrode (13), which at least superficially has a first electrode material, and with a second electrode (13') which at least superficially has a second electrode material. Furthermore, the etching body (15) is in contact, at least region-wise, with the electrolyte. In this context, the first electrode material and the second electrode material are selected such that, after the etching, the etching body (15) is not contaminated and/or is not impaired in its properties by the electrode materials. In particular, the electrode materials are the same materials as the etching material. Also proposed is a method for etching an etching body (15) using this etching cell (1), the first and/or the second electrode (13, 13') being used as a sacrificial electrode. The proposed etching cell is particularly suitable for etching silicon wafers in a CMOS-compatible production line.

28 Claims, 3 Drawing Sheets

ELECTROCHEMICAL ETCHING CELL

The present invention relates to an electrochemical etching apparatus, particularly a CMOS-compatible etching apparatus for etching silicon wafers, as well as a method for etching an etching body according to the species defined in the independent claims.

BACKGROUND INFORMATION

Electrochemical etching apparatuses, for example, for producing porous silicon or for introducing pores on the surface of silicon, are usually composed of a 2-chamber system, between which a silicon wafer to be etched is clamped as a separating wall, and the two chambers being electrically coupled or connected to one another only by the wafer. Furthermore, electrodes, generally made of platinum, are usually placed in both chambers for the current supply. For example, such an etching apparatus is already described fully and in its essential details by Fujiyama et al in the U.S. Pat. No. 5,458,755.

However, in known etching apparatuses, the problem continually occurs that at least the anodically connected electrode is at least slightly corroded and dissolved during operation, so that initially the electrolyte, and via it the wafer to be etched, becomes contaminated by the dissolved electrode material in the course of the etching process. However, in many cases, such contamination, e.g. by platinum in a silicon production, is not acceptable and impairs the etched wafer or the etching body in its electrical or catalytic properties considerably.

Thus, in particular a silicon wafer, on or in which a layer of porous silicon was produced using an electrochemical etching process and which, in so doing, was contaminated with platinum, is unsuitable for use in a CMOS production (CMOS=complementary metal-oxide semiconductor).

Proposals for solving this problem which are based upon a one-sided metallization of the wafer back side and the use of an only one-sided etching device, the back side of the wafer to be etched forming the metal contact and only the front side being in connection with the etching medium or the electrolyte and, via it, with a platinum electrode, are unsuitable because of the requisite back-side metallization to be applied and the necessary sequence steps in processing the wafer (oxidation, layer depositions, etc.), for which this metallization then stands in the way.

SUMMARY OF THE INVENTION

Compared to the related art, the electrochemical etching apparatus of the present invention for etching an etching body and the method of the present invention carried out with it having the characterizing features of the independent claims have the advantage that contamination-free electrochemical etching of an etching body is thereby permitted, at least on the surface the etching body having an etching material to be etched or being made of it. This holds true in particular for producing porous silicon from a silicon wafer. Consequently, the etching body is not impaired, particularly in its electrical, i.e. electronic or catalytic properties, by this etching.

Avoidance of contamination and/or impairment, associated at least partially with the contamination, of the electrical or catalytic properties of the etching body obtained after the etching is very advantageously achieved in that the material of the electrodes, which are directly connected to the etching body via electrolytes in the etching apparatus, is in each case selected according to the material of the etching body. When working with the etching method of the present invention using such an etching cell, at least one of these electrodes, at least with its side facing the etching body, is very advantageously used as a sacrificial electrode.

Advantageous further developments of the present invention result from the measures indicated in the dependent claims.

Thus, it is particularly advantageous if the material of a first electrode and/or the material of a second electrode, which are connected as cathode and anode, respectively, and are electrically connected to the etching body via a suitable electrolyte, is the same material as the etching material of the etching body to be etched. In this context, it is sufficient if the etching body, at least on the surface, has the etching material to be etched or is made superficially of it, and if the first and/or second electrode, at least on the surface, has a corresponding electrode material or is made superficially of it.

Furthermore, it is very advantageous if the etching material of the etching body is at least weakly electrically conductive, silicon preferably being used as etching material or a silicon wafer being used as the etching body. It is also advantageous if the first electrode material and the second electrode material of the first and second electrode, respectively, is a CMOS-compatible material, and in particular is not an element selected from the group platinum, gold, iridium, rhodium, palladium, silver or copper. Consequently, the etching apparatus of the present invention is particularly suitable for producing porous silicon on a silicon wafer, contamination of the wafer with silicon-foreign substances such as platinum or palladium being prevented, for example, by the use of silicon electrodes.

In this context, understood by a CMOS-compatible material according to the general usage in semiconductor technology is a material which does not negatively affect the electrical properties of a circuit produced with it.

Accordingly, to be understood by a material contaminating the etching body is, in particular, a CMOS poison or a material which, given its embedment, forms deep imperfections in the etching body, that is to say, imperfections whose energy levels lie in the middle of the gap between conduction band and valence band of the material to be etched and which consequently give rise to a high transition matrix element for the recombination of electrons and holes in the etching body ("recombination seed").

Advantageously suitable as electrode materials for the first and second electrodes, respectively, are especially compounds from the group of the at least weakly conductive compounds of the elements silicon, carbon, nitrogen, oxygen, titanium, aluminum, boron, antimony, tungsten, cobalt, tellurium, germanium, molybdenum, gallium, arsenic and selenium, particularly SiC, SiN, TiN, TiC, $MoSi_2$ und GaAs, as well as pure electrode materials from the elements silicon, titanium, tungsten, molybdenum and carbon, particularly graphite.

Generally, the materials commonly used as contact materials in semiconductor technology are also suitable as electrode materials, since they do not diffuse deeply into the etching body upon striking it, and therefore during the etching, but rather react superficially with the etching body, i.e. are locally bound forming, for example, silicides, and thus remain restricted on the surface of the etching body. Thus, in this sense they do not contaminate the etching body and also do not impair it in its electronic properties, particularly with respect to the use in, or compatibility with, a CMOS-compatible production line.

Advantageously, in each case, the respective electrode material is specifically selected taking into consideration the material of the etching body and the electrolytes used. In addition, the first electrode and/or the second electrode and/or the etching body are advantageously planar, particularly in the form of wafers, the electrodes for use as sacrificial electrodes very advantageously being substantially thicker than the actual etching body besides, so that if desired, they can be recovered, freed from contamination and reused. The exchange cycles of the electrodes are thereby advantageously prolonged.

The electrochemical etching cell is advantageously constructed such that a first chamber and a second chamber are provided which are each filled at least partially with an electrolyte and which are separated spatially from each other via a separating device. Each of the two chambers is electroconductively connected via an electrolyte to an electrode, the etching body at least region-wise being the separating device, and at the same time very advantageously also being the only, at least weakly conductive electrical connection between the two chambers and the electrodes connected as cathode and anode, respectively.

A further very advantageous embodiment of the invention provides that, in addition to the two chambers already mentioned, the electrochemical etching cell is provided with a further third chamber, or a further third chamber and a further fourth chamber, which are each at least partially filled with an electrolyte and in each case are spatially separated from the first chamber and second chamber, respectively, via a further separating device. In this case, the electrolyte in the third and fourth chamber, respectively, is very advantageously electroconductively connected only to the second and first electrode, respectively, which in turn simultaneously serve at least region-wise as the separating device between the third and fourth chamber and the first and second chamber, respectively.

In this connection, it is particularly advantageous if, only with their surface facing the etching body, are the especially planar first and/or the second electrode in contact with the electrolyte that is in contact with the etching body, so that the electrolyte in the third and fourth chamber is prevented from mixing with the electrolyte in the first and second chamber, respectively. Therefore, for simpler electrical contacting of the electrodes, the side of the first and/or second electrode facing away from the electrolyte of the first or second chamber can be provided superficially at least region-wise with a metallization or a doping or, for example, in the case when the electrode is composed of a plurality of layers, can be made of a metal, which combines the advantage of a simple constructional design of the etching cell with the purposeful adaptation of the electrode material to the respective etching material without contacting or contamination problems occurring.

Furthermore, for easy electrical contacting of the first and second electrodes via the respective electrolyte, provision can be made in the third and fourth chamber, respectively, for an additional bath electrode, particularly a platinum or palladium electrode, dipping into an electrolyte located there.

Incidentally, the electrolytes in the individual chambers of the etching apparatus according to the present invention can advantageously also be different from one another, the first and second chambers in which the actual etching of the etching body takes place being advantageously filled with hydrofluoric acid or a mixture of hydrofluoric acid and ethanol, and the third and fourth chambers, for example, being filled with diluted sulfuric acid as contact electrolyte.

Furthermore, the individual chambers are very advantageously capable of being filled separately with electrolyte and emptied separately, thus allowing a problem-free exchange, for example, of a contaminated electrolyte in each chamber at any time. Consequently, in addition a simple exchange of an exhausted or contaminated first and/or second electrode used as a sacrificial electrode is made possible easily and quickly at any time.

Incidentally, the first and/or second electrode is advantageously electrically contacted via the electrolyte, filled into the third and fourth chamber, respectively, to a bath electrode located there, and thus is connected to an external voltage supply which impresses a current on the etching apparatus during operation.

Moreover, the problem-free exchangeability of the sacrificial electrodes, i.e. the first and/or the second electrode, very advantageously makes it possible, in a simple manner, to investigate the suitability of different electrode materials such as graphite, for example, during the etching of an etching body, and in so doing, to optimize the electrode materials to the respective material of the etching body.

In addition, to homogenize the etching of the etching body in the etching apparatus according to the present invention, a tunnel of non-conductive material, particularly polypropylene, can advantageously be provided in a manner known per se.

BRIEF DESCRIPTION OF THE DRAWING

The present invention is explained in greater detail in the following description with reference to the Drawing.

EXEMPLARY EMBODIMENTS

Figure 1:
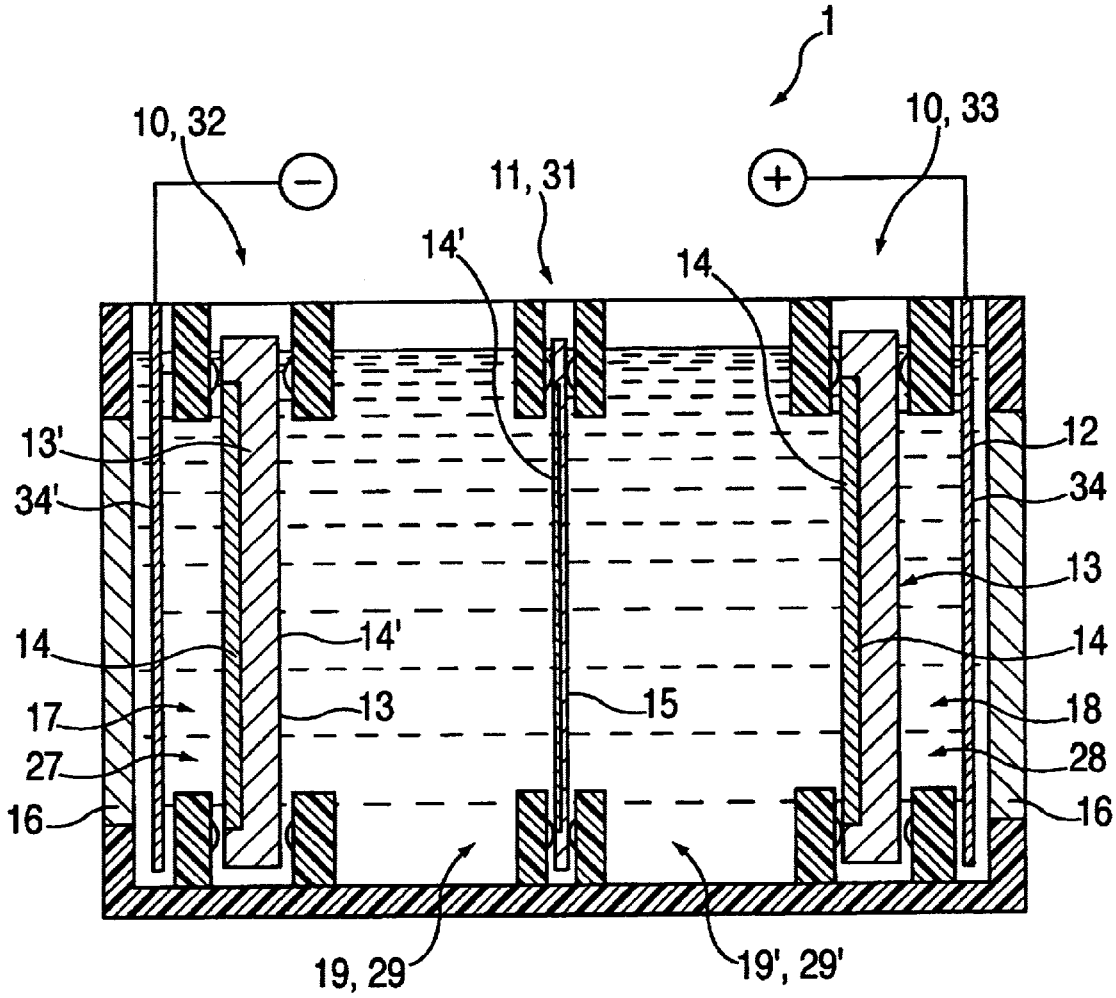
FIG. 1 shows a first electrochemical etching apparatus.

FIG. 1, as a first exemplary embodiment, shows an electrochemical etching cell 1 of the present invention having four chambers, a first chamber 19, a second chamber 19', a third chamber 17 and a fourth chamber 18, each of which is filled at least partially with an electrolyte. First and second chambers 19, 19' are filled, for example, with a mixture of hydrofluoric acid and ethanol for the actual etching of an etching body 15, while third and fourth chambers 17, 18 are filled, for example, with diluted sulfuric acid as contact electrolyte. The four chambers 17, 18, 19, 19' therefore define four electrolyte regions allocated to chambers 17, 18, 19, 19', a first electrolyte region 29, a second electrolyte region 29', a third electrolyte region 27 and a fourth electrolyte region 28 that are separated spatially from one another via separating devices which at the same time, however, permit an electrical connection of chambers 17, 18, 19, 19'.

In detail, first chamber 19 is spatially separated from second chamber 19' via a first separating device 31, first chamber 19 is spatially separated from third chamber 17 via a second separating device 32, and second chamber 19' is spatially separated from fourth chamber 18 via a third separating device 33, so that no electrolyte is exchanged between chambers 17, 18, 19, 19'.

In this context, first separating device 31 is formed in a manner known per se by an etching-body holding device 11 made of Teflon or polypropylene, in which etching body 15 is fitted or inserted region-wise so that it is in contact superficially with the electrolyte in first chamber 19 on one side, and with the electrolyte in second chamber 19' on the other side. In the example explained, etching body 15 is a generally known, planar silicon wafer. Second separating device 32 and third separating device 33 are formed in each case by an electrode holding device 10 made of Teflon, into which a second electrode 13' and a first electrode 13, respectively, are inserted region-wise, so that at least region-wise, they are superficially in contact with the electrolyte of third and first chambers 17, 19', respectively, on one hand, and with the electrolyte of second and fourth chambers 19', 18, respectively, on the other hand.

As metallic contact electrode for contacting first and second electrodes 13, 13', respectively, in each case provision is made in third and fourth chambers 17, 18 for a platinum electrode or a palladium electrode as bath electrode 34, 34', which in each case dips into the electrolyte located there. Bath electrodes 34, 34' are further connected to a voltage source (not shown) which impresses an electric current on etching cell 1 in a generally known manner. In the explained example, relative to etching body 15, first electrode 13, i.e. its side facing etching body 15, is connected as anode, and second electrode 13', i.e. its side facing etching body 15, is connected as cathode.

In the example explained, first electrode 13 and second electrode 13' are made of a planar silicon wafer or a silicon disk that is preferably substantially thicker than the silicon wafer used as etching body 15. In general, electrodes 13, 13' are preferably selected with respect to the electrode material used in each case, such that they are made at least superficially of the same material as the respective surfaces of etching body 15. This ensures that the material of first electrode 13 and the material of second electrode 13' do not contaminate etching body 15 during operation of etching cell 1, and therefore do not impair its electrical or catalytic properties after the etching.

During operation of etching cell 1, an external applied current now flows across bath electrodes 34, 34', the electrolytes, first and second electrodes 13, 13' and etching body 15, etching body 15 being etched at least superficially in a body etching region 14'. At the same time, however, depending on the selection of the material of electrodes 13, 13', first and second electrodes 13, 13' are also etched, at least superficially, in an etching region 14, that is to say, they are used as sacrificial electrodes during the etching process of etching body 15. In this context, however, because of their markedly greater thickness compared to etching body 15, they are not etched through, but are merely superficially corroded, etched off, ablated or, for example, receive pores. When worn out, for example, after etching a plurality of etching bodies 15, they can therefore be exchanged, recovered again or, if necessary, cleaned regularly of adhering contamination.

In detail, in the example explained, during the etching of a silicon wafer, porous silicon develops on its anodic side, i.e. in the case of the indicated polarity, in body etching region 14', while at the same time on the anodic side of first electrode 13 facing the etching body an at least slight etching likewise occurs in a corresponding electrode etching region 14, that is to say, in the specific example, a superficial formation of porous silicon. Incidentally, this also holds true for the side of second electrode 13' facing away from etching body 15, this electrode assuming the role of the anode in third chamber 17. At the same time, anodically connected metallic bath electrode 34 in fourth chamber 18 also dissolves slightly during operation of etching cell 1, however only the side of first electrode 13 facing away from etching body 15 being contaminated, for example, with platinum. However, because of the spatial separation of individual chambers 17, 18, 19, 19' between which only an electrical connection exists via electrodes 13, 13' and etching body 15, but between which no electrolyte exchange is possible, this contamination stays away from etching body 15. Consequently, the contamination can be removed again from the corresponding side during a recovery of electrodes 13, 13'.

Dissolving of silicon from one of electrodes 13, 13' in the electrolyte in first or second chamber 19, 19' occurring, for example, during the etching, is not critical for etching body 15, since it is made of the same material and therefore does not become contaminated.

Incidentally, for easy exchange of electrodes 13, 13', they are preferably joined to electrode holding devices 10 via seals, and are screwed to etching apparatus 1 via closable windows 16 in side walls of etching apparatus 1. A generally known quick-change fastener is further provided for easy exchange of etching body 15.

In addition, for easy exchange of the electrolyte and electrodes 13, 13' used, chambers 17, 18, 19, 19', i.e. associated electrolyte regions 27, 28, 29, 29' are each able to be filled and emptied separately by way of suitable, generally-known devices.

Figure 2:
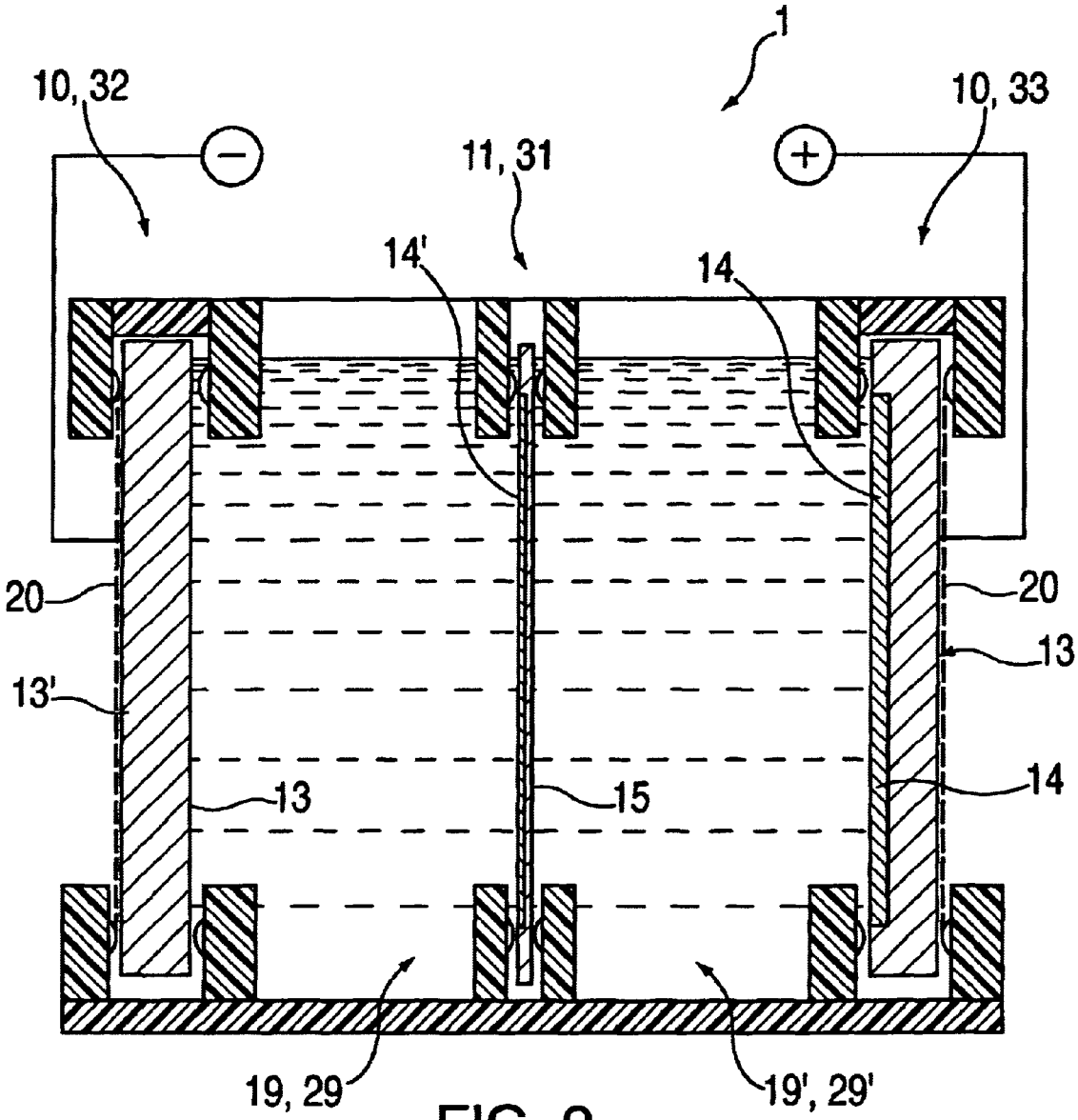
FIG. 2 shows an alternative specific embodiment of the etching apparatus.

FIG. 2 clarifies a second exemplary embodiment of an etching cell according to the present invention. This etching cell is completely analogous to etching cell 1 according to FIG. 1 in essential points, but has a different specific embodiment of the contacting of electrodes 13, 13'. In this example, it is possible to dispense with third chamber 17 and fourth chamber 18, bath electrodes 34, 34' and the electrolytes in these chambers 17, 18. Instead, first electrode 13 and second electrode 13' are each provided with a generally known metallization 20 on the side facing away from etching body 15.

Alternatively, however, electrodes 13, 13' can also be provided with a very high doping on this side, thus ensuring good electrical conductivity. Finally, electrodes 13, 13' can also be made of a stratified body which has a metal layer on its side facing away from etching body 15, or is made of a metal. Further specific embodiments of the electrical contacting of electrodes 13, 13' provide that, in a manner known per se, they are furnished with pin-, screen- or surface contacts on the side facing away from etching body 15 or, depending on the electrode material, that electrodes 13, 13' in first and second chambers 19, 19' are, particularly simply, partially immersed directly in the electrolytes and are directly electrically contacted at a location not immersed.

Thus, they are used as sacrificial electrodes instead of the platinum electrodes known from the related art.

However, in the case of graphite as electrode material for first and second electrodes 13, 13', contacting via an electrolyte in third and fourth chambers 17, 18, respectively, according to FIG. 1 is advantageous.

Figure 3:
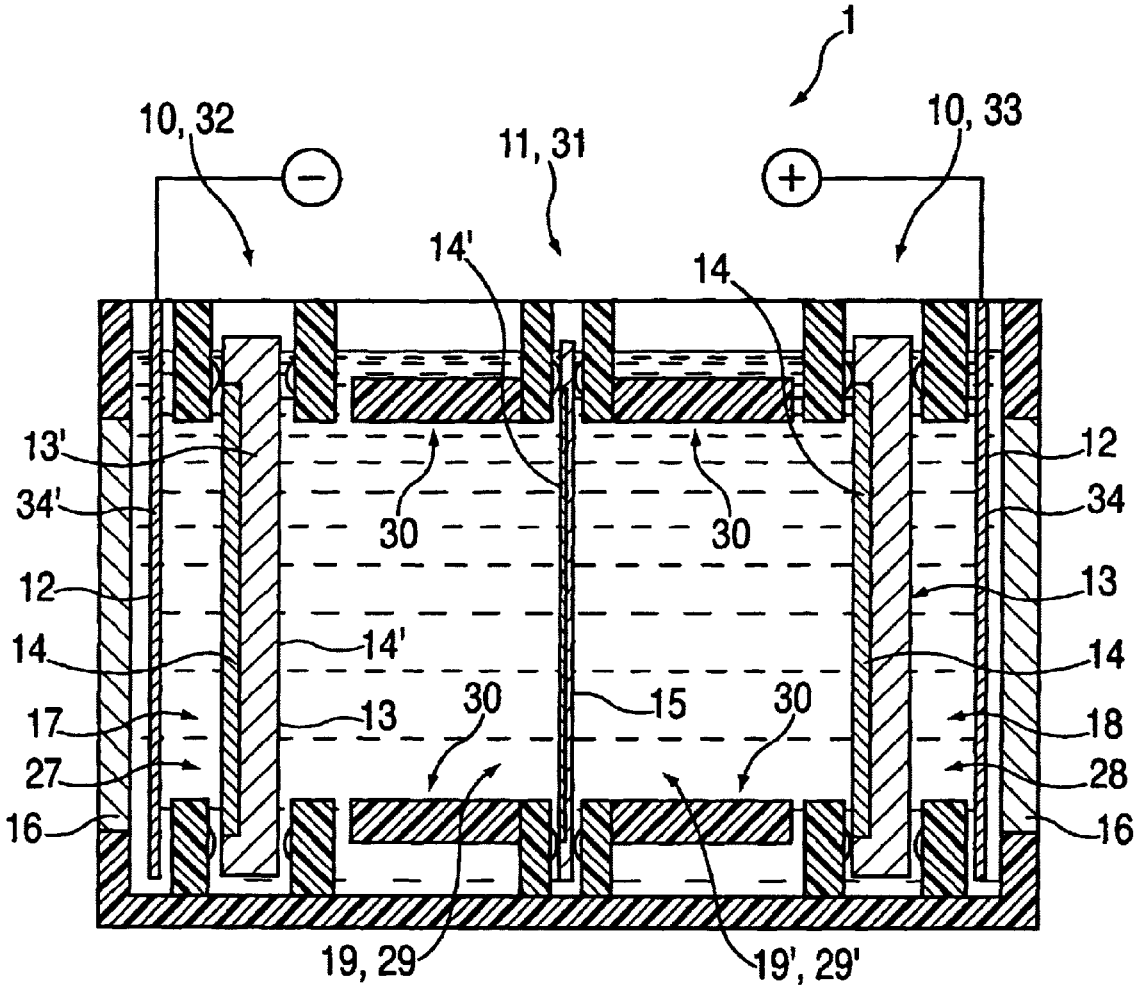
FIG. 3 shows a third specific embodiment of the etching apparatus.

Finally, reference should still be made to a third exemplary embodiment of the etching apparatus according to the present invention, clarified with the aid of FIG. 3, in which, in contrast to FIG. 1, merely one generally-known tunnel 30 made of non-conductive material such as polypropylene is additionally provided. This tunnel 30 is joined on both sides to etching-body holding device 11 and concentrically surrounds a, for example, circular wafer as etching body 15. Tunnel 30 causes homogenization of the flow lines in etching apparatus 1, and thus an excellent thickness homogeneity of the etching of etching body 15, particularly when etching silicon to form porous silicon.

Further details of the above exemplary embodiments, which are known per se to one skilled in the art and are already fully explained, for example, in U.S. Pat. No. 5,458,755, are dispensed with.

List of reference numerals

1 Etching cell
10 Electrode holding device
11 Etching-body holding device
12 Metal electrode
13 First electrode
13' Second electrode
14 Electrode etching region
14' Body etching region
15 Etching body
16 Window
17 Third chamber
18 Fourth chamber
19 First chamber
19' Second chamber
20 Metallization
27 Third electrolyte region
28 Fourth electrolyte region
29 First electrolyte region
29' Second electrolyte region
30 Tunnel
31 First separating device
32 Second separating device
33 Third separating device
34 Bath electrode
34' Bath electrode

What is claimed is:

1. An electrochemical etching cell for etching an etching body that is made at least superficially of silicon, comprising:

at least two chambers filled at least partially with an electrolyte, one of which is provided with a first electrode that at least superficially has a first electrode material and the other of which is provided with a second electrode that at least superficially has a second electrode material, wherein one of the electrodes is connected as a cathode and the other of the electrodes is connected as an anode;

wherein the etching body contacts at least region-wise with the electrolyte; and wherein the first electrode material and the second electrode material include an at least weakly conductive compound including at least one of silicon, carbon, nitrogen, oxygen, titanium, aluminum, boron, antimony, tungsten, cobalt, tellurium, germanium, molybdenum, gallium, arsenic and selenium.

2. The electrochemical etching cell of claim 1, wherein the first electrode material and the second electrode material include an at least weakly conductive compound that includes at least one of SiC, SiN, TiN, TiC, $MoSi_2$ and GaAs.

3. The electrochemical etching cell of claim 1, wherein at least one of the first electrode material and the second electrode material is made of the same material as the etching material.

4. The electrochemical etching cell of claim 1, wherein the etching material is at least weakly electroconductive.

5. The electrochemical etching cell of claim 4, wherein the etching material is silicon and the etching body is a silicon wafer.

6. The electrochemical etching cell of claim 1, wherein the first electrode material and the second electrode material include CMOS-compatible materials.

7. The electrochemical etching cell of claim 1, wherein the first electrode material and the second electrode material do not include of any of platinum, gold, iridium, rhodium, palladium, silver and copper.

8. The electrochemical etching cell of claim 1, wherein at least one of the first electrode, the second electrode and the etching body is planar.

9. The electrochemical etching cell of claim 8, wherein the surfaces of the first electrode and the second electrode facing the etching body are in contact at least region-wise with the electrolyte which is in contact with the etching body.

10. The electrochemical etching cell of claim 1, wherein the at least two chambers include a first chamber and a second chamber, each of which is filled at least partially with an electrolyte and which are spatially separated from each other via a first separating device.

11. The electrochemical etching cell of claim 10, further comprising:

a third chamber at least partially filled with an electrolyte and spatially separated from the first chamber via a second separating device, the third chamber being electroconductively coupled to the second electrode and the second electrode at least region-wise forming the second separating device.

12. The electrochemical etching cell of claim 11, further comprising:

a fourth chamber at least partially filled with an electrolyte and spatially separated from the second chamber via a third separating device, the fourth chamber being electroconductively coupled to the first electrode, and the first electrode at least region-wise forming the third separating device.

13. The electrochemical etching cell of claim 10, wherein the first chamber and the second chamber are electroconductively coupled via the etching body.

14. The electrochemical etching cell of claim 12, wherein at least one of i) the first chamber and the third chamber are electroconductively intercoupled via the second electrode and ii) the second chamber and the fourth chamber are electroconductively intercoupled via the first electrode.

15. The electrochemical etching cell of claim 10, wherein at least one of i) the first electrode is planar and is electroconductively coupled only on one side to the electrolyte of the second chamber, and ii) the second electrode is planar and is electroconductively coupled only on one side to the electrolyte of the first chamber.

16. The electrochemical etching cell of claim 12, wherein at least one of i) the first electrode is planar and one side is electroconductively coupled to the electrolyte of the second chamber, with the other side electroconductively coupled to the electrolyte of the fourth chamber and ii) the second electrode is planar and one side is electroconductively coupled to the electrolyte of the first chamber, with the other side electroconductively coupled to the electrolyte of the third chamber.

17. The electrochemical etching cell of claim 10, wherein at least one of the side of the first electrode facing away from the electrolyte of the first chamber and the side of the second electrode facing away from the electrolyte of the second chamber is one of made of metal, provided superficially, at least region-wise, with a metallization and provided superficially, at least region-wise, with a high doping.

18. The electrochemical etching cell of claim 12, wherein at least one of the following is satisfied: the first electrode is coupled via the electrolyte in the third chamber to a bath electrode; and the second electrode is coupled via the electrolyte in the fourth chamber to the bath electrode.

19. The electrochemical etching cell of claim 13, wherein the bath electrode is a platinum electrode.

20. The electrochemical etching cell of claim 12, wherein the chambers are filled with different electrolytes.

21. The electrochemical etching cell of claim 20, wherein the first and second chambers are filled with one of hydrofluoric acid and a mixture of hydrofluoric acid and ethanol, and the third and fourth chambers are filled with diluted sulfuric acid.

22. The electrochemical etching cell of claim 1, wherein a tunnel made of non-conductive material is provided to homogenize the etching of the etching body.

23. The electrochemical etching cell of claim 22, wherein the tunnel is made of polypropylene.

24. The electrochemical etching cell of claim 22, wherein the chambers are fillable and emptiable separately.

25. The electrochemical etching cell of claim 1, wherein at least one of the first electrode and the second electrode is used as a sacrificial electrode.

26. The electrochemical etching cell of claim 1, wherein during etching, at least region-wise, at least one of the first and the second electrode receives pores on the surface.

27. The electrochemical etching cell of claim 1, wherein the electrodes are considerably thicker than the etching body.

28. The electrochemical etching cell of claim 1, wherein the cell is used in etching silicon wafers in a CMOS-compatible production line.

* * * * *